US011673406B2

(12) United States Patent
Granek et al.

(10) Patent No.: US 11,673,406 B2
(45) **Date of Patent: *Jun. 13, 2023**

(54) METHOD OF PRINTING FLUID

(71) Applicant: XTPL S.A., Wroclaw (PL)

(72) Inventors: Filip Granek, Wroclaw (PL); Aneta Wiatrowska, Wroclaw (PL); Krzysztof Fijak, Wroclaw (PL); Michal Dusza, Wroclaw (PL); Przemyslaw Cichon, Wroclaw (PL); Piotr Kowalczewski, Wroclaw (PL)

(73) Assignee: XTPL S.A., Wroclaw (PL)

( * ) Notice: Subject to any disclaimer, the term of this patent is extended or adjusted under 35 U.S.C. 154(b) by 131 days.

This patent is subject to a terminal disclaimer.

(21) Appl. No.: 17/425,638

(22) PCT Filed: Mar. 20, 2019

(86) PCT No.: PCT/IB2019/052287
§ 371 (c)(1),
(2) Date: Jul. 23, 2021

(87) PCT Pub. No.: WO2020/157548
PCT Pub. Date: Aug. 6, 2020

(65) Prior Publication Data

US 2022/0097404 A1 Mar. 31, 2022

(51) Int. Cl.
*B41J 2/175* (2006.01)

(52) U.S. Cl.
CPC ..... *B41J 2/17596* (2013.01)

(58) Field of Classification Search
CPC . B41J 25/3086; B41J 3/28; B41J 2/175; B41J 3/407; B41J 2/17596; B41J 2/07; B41J 2/04; B41J 2/04505
See application file for complete search history.

(56) References Cited

U.S. PATENT DOCUMENTS 8,562,095 B2 * 10/2013 Alleyne ..... B41J 2/06 347/14
10,518,527 B2 * 12/2019 Poulikakos ..... B41J 2/145
(Continued)

FOREIGN PATENT DOCUMENTS

| | | | |
|---|---|---|---|
| CA | 2405160 | A1 | 10/2001 |
| WO | 0001798 | A2 | 1/2000 |
| WO | 2020157548 | A1 | 8/2020 |

OTHER PUBLICATIONS

International Search Report and Written Opinion for International PCT Application No. PCT/IB2019/052287, dated Oct. 28, 2019.

*Primary Examiner* — An H Do
(74) *Attorney, Agent, or Firm* — K&L Gates LLP

(57) ABSTRACT

Method of printing fluid on a printable surface of a substrate. A print head ejects fluid in a continuous stream. The print head that includes a micro-structural fluid ejector, which consists of output, elongate input, and tapering portions between the output and the elongate input portions. The output consists of an exit orifice of an inner diameter ranging between 0.1 μm and 5 μm and an end face having a surface roughness of less than 0.1 μm. The print head is positioned above the substrate with the output of the micro-structural fluid ejector pointing downward. During printing, the print head positioning system maintains a vertical distance between the end face and the printable surface of the substrate within a range of 0 μm to 5 μm, and the pneumatic system applies pressure to the fluid in the micro-structural fluid ejector in the range of −50,000 Pa to 1,000,000 Pa.

33 Claims, 18 Drawing Sheets

(56) References Cited

U.S. PATENT DOCUMENTS

| | | | | |
|---|---|---|---|---|
| 10,864,730 | B2 * | 12/2020 | Byun | B41J 2/06 |
| 2011/0187798 | A1 | 8/2011 | Robers et al. | |
| 2014/0092158 | A1 | 4/2014 | Alleyne et al. | |

* cited by examiner

METHOD OF PRINTING FLUID

CROSS-REFERENCE TO RELATED APPLICATIONS

This application is a U.S. National Stage Entry under 35 U.S.C. § 371 of International Patent Application No. PCT/IB2019/052287, entitled METHOD OF PRINTING FLUID, filed Aug. 8, 2020, which claims benefit to Polish Application No. PL428770, filed Feb. 1, 2019 and Polish Application No. PL429147, filed Mar. 5, 2019, entitled METHOD OF PRINTING FLUID, the entire disclosures of which are hereby incorporated by reference herein.

BACKGROUND

Metal lines can be formed by photolithographic patterning of a photoresist layer followed by etching of an underlying metal layer using the patterned photoresist as a mask. However, because of the high cost of photolithography and etch equipment, there is a need for highly productive alternatives, particularly for line widths in the range of about 1 μm to about 10 μm.

Ink jet printing is an additive process that could be highly productive. In contrast to photolithography and etch, which is a subtractive process, there is less wasted material. This is a consideration particularly for forming patterns of high cost materials, such as quantum dots. Nevertheless, it has been found that conventional ink jet printing processes are not optimal for forming patterns with line widths in the range of about 1 μm to about 10 μm.

SUMMARY

In one aspect, the present disclosure relates to a method of printing a fluid on a printable surface of a substrate. According to the method, a print head ejects fluid in a continuous stream. The method includes providing a print head that includes a micro-structural fluid ejector, which consists of an output portion, an elongate input portion, and a tapering portion between the output portion and the elongate input portion. The output portion consists of an exit orifice of an inner diameter ranging between 0.1 μm and 5 μm and an end face having a surface roughness of less than 0.1 μm. The print head is positioned above the substrate with the output portion of the micro-structural fluid ejector pointing downward. During printing, the print head positioning system maintains a vertical distance between the end face and the printable surface of the substrate within a range between 0 μm and 5 μm, and the pneumatic system applies pressure to the fluid in the micro-structural fluid ejector in the range of −50,000 Pa to 1,000,000 Pa.

In another aspect, the output portion of the micro-structural fluid ejector is maintained in contact with the printable surface of the substrate during printing. When the tapering portion is tilted or bent along the direction of lateral displacement, an imaging system detects the tilt or bend of the tapering portion, and the vertical displacement of the output portion is adjusted in response to the detected tilt or bend.

In yet another aspect, a vertical displacement sensor measures a reference vertical displacement between the vertical displacement sensor and a reference location on the printable surface, and the vertical displacement of the output portion is adjusted in response to the reference vertical displacement.

In yet another aspect, the position of the output portion of the micro-structural fluid ejector is calibrated using a tuning fork, the coordinates of which are precisely known in a first coordinate system. The resonance frequency of the tuning fork is measurably perturbed when the output portion comes into contact therewith.

In yet another aspect, a glass tube is installed in a focused-ion beam apparatus, and the focused ion beam is used to cut across the tapering portion to define an output portion including an exit orifice and an end face. The focused ion beam is used to polish the end face to obtain a micro-structural fluid ejector.

In yet another aspect, the micro-structural fluid ejector is mounted in a mounting receptacle. The micro-structural fluid ejector is rotatable about its longitudinal axis, and a rotation device is coupled to the micro-structural fluid ejector to impart controlled rotation to the micro-structural fluid ejector about its longitudinal axis.

In yet another aspect, a method of printing a fluid on a printable surface of a substrate includes providing a print head module. The print head module includes a common rail and a bank of micro-structural fluid ejectors arrayed along the common rail. The micro-structural fluid ejectors print fluid concurrently for higher productivity. The common rail is suspended from the base support of the print head module by piezoelectric stack linear actuators positioned near the ends of the common rail. A vertical displacement sensor is positioned at each end of the common rail and is configured to measure respective reference vertical displacements to reference locations on the printable surface. In response to the respective reference vertical displacements, the piezoelectric stack linear actuators adjust the respective vertical separations between the ends and the base support.

The above summary is not intended to describe each disclosed embodiment or every implementation of the claimed subject matter. The description that follows more particularly exemplifies illustrative embodiments. In several places throughout the application, guidance is provided through examples, which examples can be used in various combinations. In each instance of a list, the recited list serves only as a representative group and should not be interpreted as an exclusive list.

BRIEF DESCRIPTION OF THE FIGURES

The disclosure may be more completely understood in consideration of the following detailed description of various embodiments of the disclosure in connection with the accompanying drawings, in which.

DETAILED DESCRIPTION OF ILLUSTRATIVE EMBODIMENTS

Applicant of the present application owns the following Poland Patent Applications, the disclosure of each of which is herein incorporated by reference in its entirety:

Poland Application No. PL429145 titled FLUID PRINTING APPARATUS, filed Mar. 5, 2019;

Poland Application No. PL429147 titled METHOD OF PRINTING FLUID, filed Mar. 5, 2019;

Poland Application No. PL428963 titled CONDUCTIVE INK COMPOSITIONS, filed Feb. 19, 2019;

Poland Application No. PL428769 titled FLUID PRINTING APPARATUS, filed Feb. 1, 2019; and Poland Application No. PL428770 titled METHOD OF PRINTING FLUID, filed Feb. 1, 2019.

The present disclosure relates to a method of printing a fluid on a printable surface of a substrate. According to the method, a print head ejects fluid in a continuous stream. The method includes providing a print head that includes a micro-structural fluid ejector, which consists of an output portion, an elongate input portion, and a tapering portion between the output portion and the elongate input portion. The output portion consists of an exit orifice of an inner diameter ranging between 0.1 μm and 5 μm and an end face having a surface roughness of less than 0.1 μm. The print head is positioned above the substrate with the output portion of the micro-structural fluid ejector pointing downward. During printing, the print head positioning system maintains a vertical distance between the end face and the printable surface of the substrate within a range of 0 μm to 5 μm, and the pneumatic system applies pressure to the fluid in the micro-structural fluid ejector in the range of −50,000 Pa to 1,000,000 Pa.

In this disclosure:

The words "preferred" and "preferably" refer to embodiments of the claimed subject matter that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the claimed subject matter.

The terms "comprises" and variations thereof do not have a limiting meaning where these terms appear in the description and claims.

Unless otherwise specified, "a," "an," "the," and "at least one" are used interchangeably and mean one or more than one.

Also, the recitations of numerical ranges by endpoints include all numbers subsumed within that range (e.g., 1 to 5 includes 1, 1.5, 2, 2.75, 3, 3.80, 4, 5, etc.).

For any method disclosed herein that includes discrete steps, the steps may be conducted in any feasible order. And, as appropriate, any combination of two or more steps may be conducted simultaneously.

Figure 1:
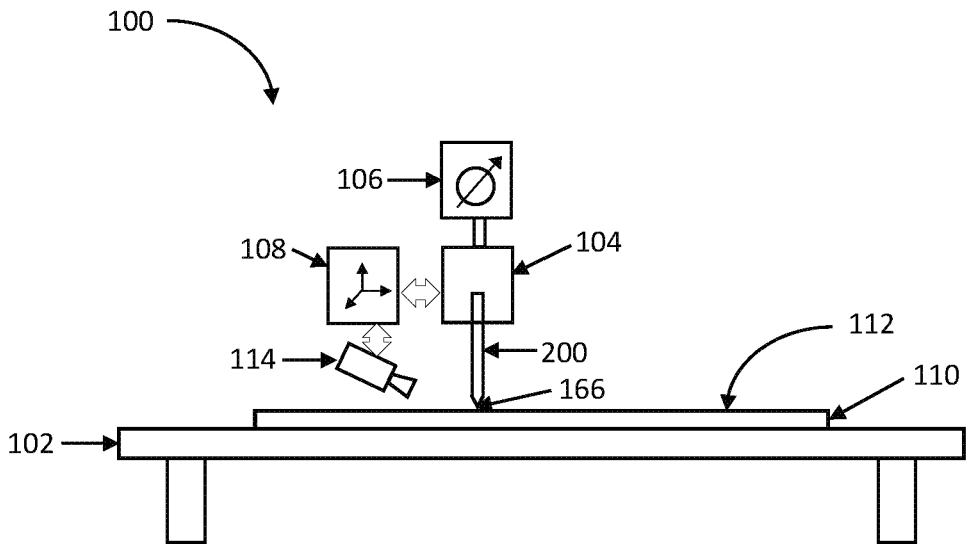
FIG. 1 is a block diagram view of an illustrative fluid printing apparatus according to a first embodiment.

An illustrative fluid printing apparatus according to a first embodiment is explained with reference to FIG. 1. FIG. 1 is a block diagram view of an illustrative fluid printing apparatus according to the first embodiment. The fluid printing apparatus 100 includes a substrate stage 102, a print head 104, a pneumatic system 106, and a print head positioning system 108. A substrate 110 is fixed in position on the substrate stage 102 during the printing and has a printable surface 112, which is facing upward and facing towards the print head 104. The print head 104 is positioned above the substrate 110.

The substrate 110 can be of any suitable material, such as glass, plastic, metal, or silicon. A flexible substrate can also be used. Furthermore, the substrate can have existing metal lines, circuitry, or other deposited materials thereon. For example, the present disclosure relates to an open defect repair apparatus, which can print lines in an area where there is an open defect in the existing circuit. In such case, the substrate can be a thin-film transistor array substrate for a liquid crystal display (LCD).

The print head 104 includes a micro-structural fluid ejector, according to a second embodiment. The inventors have found that commercially available capillary glass tubes can be modified to be used as the micro-structural fluid ejector in the present disclosure. For example, capillary glass tubes called Eppendorf™ Femtotips™ Microinjection Capillary Tips, with an inner diameter at the tip of 0.5 μm, are available from Fisher Scientific. A commercially available capillary glass tube 120 is shown schematically in FIG. 2. A plastic handle 122 is attached to the capillary glass tube 120 around its circumference. The plastic handle 122 includes an input end 124 and a threaded portion 126 near the input end 124 which enables a threaded connection to an external body or external conduit (not shown in FIG. 2). The input end 124 has an inner diameter of 1.2 mm.

Figure 3:
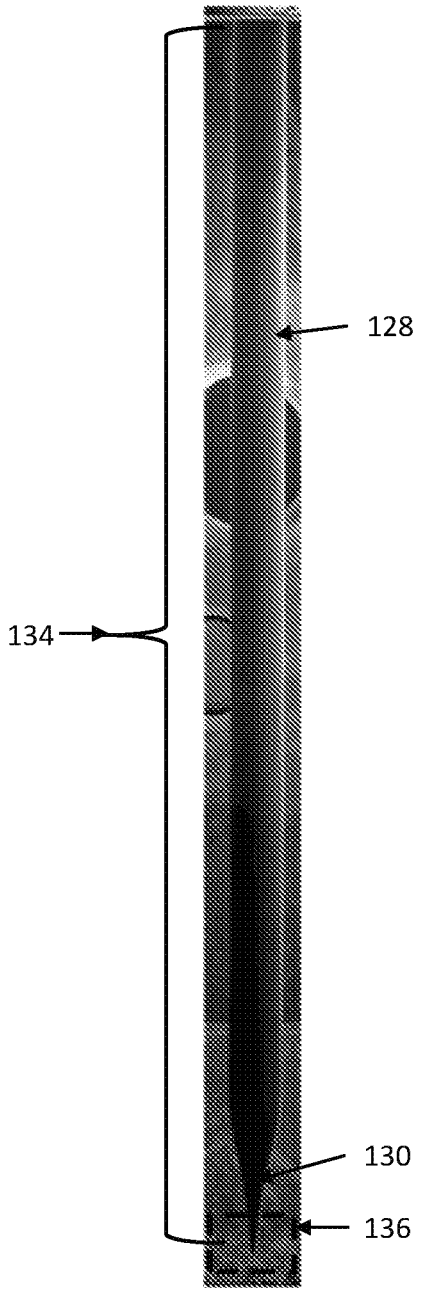
FIG. 3 is a scanning electron microscope (SEM) view of a portion of a capillary glass tube.
Figure 4:
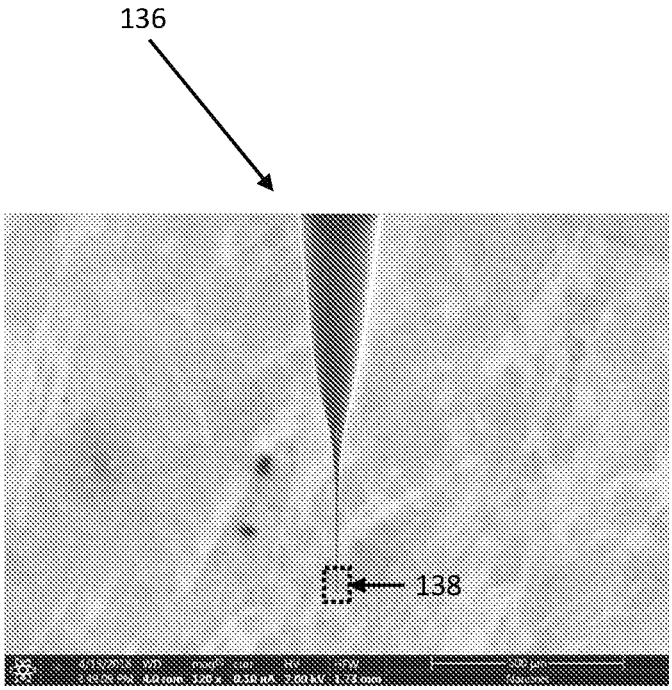
FIG. 4 is a scanning electron microscope (SEM) view of a tapering portion of the capillary glass tube, under low magnification.
Figure 5:
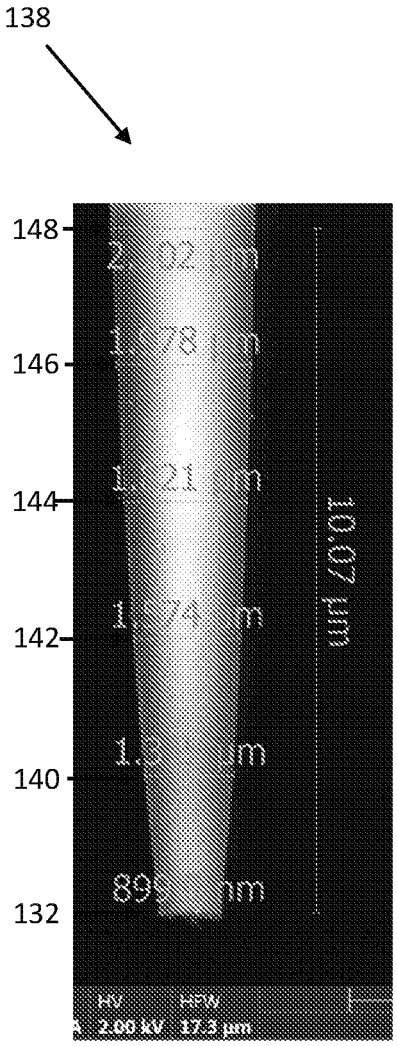
FIG. 5 is a scanning electron microscope (SEM) view of a tapering portion of the capillary glass tube, under high magnification.

The capillary glass tube includes an elongate input portion 128 and a tapering portion 130. There is an externally visible portion 134 of the capillary glass tube 120. Some of the elongate input portion 128 may be obscured by the surrounding plastic handle 122. The tapering portion 130 tapers to an output end 132 with a nominal inner diameter of 0.5 μm. The reduction of diameter along the tapering portion 130 from the elongate input portion 128 to the output end 132 is more clearly illustrated in FIGS. 3 through 5. FIG. 3 is a scanning electron micrograph view (formed from stitching together multiple SEM images) of the entire externally visible portion 134 of the capillary glass tube 120. A first magnification region 136 of the tapering portion 130 including the output end 132, observed under low magnification in a scanning electron microscope (SEM), is shown in FIG. 4. Furthermore, a second magnification region 138 located within the first magnification region 136, observed under high magnification in a scanning electron microscope (SEM), is shown in FIG. 5. In FIG. 5, the outer diameter measured at the output end 132 and at different longitudinal locations along the tapering portion (140, 142, 144, 146, and 148) are shown in FIG. 5 and in Table 1. The outer diameter is smallest at the output end 132 and increases with increasing longitudinal distance from the output end 132. A longitudinal distance 90 between output end 136 and longitudinal location 148 is measured to be approximately 10.07 μm.

TABLE 1

| Longitudinal Location | Outer diameter (μm) |
|---|---|
| 148 | 2.102 |
| 146 | 1.978 |
| 144 | 1.821 |
| 142 | 1.574 |
| 140 | 1.315 |
| 132 | 0.8993 |

Figure 2:
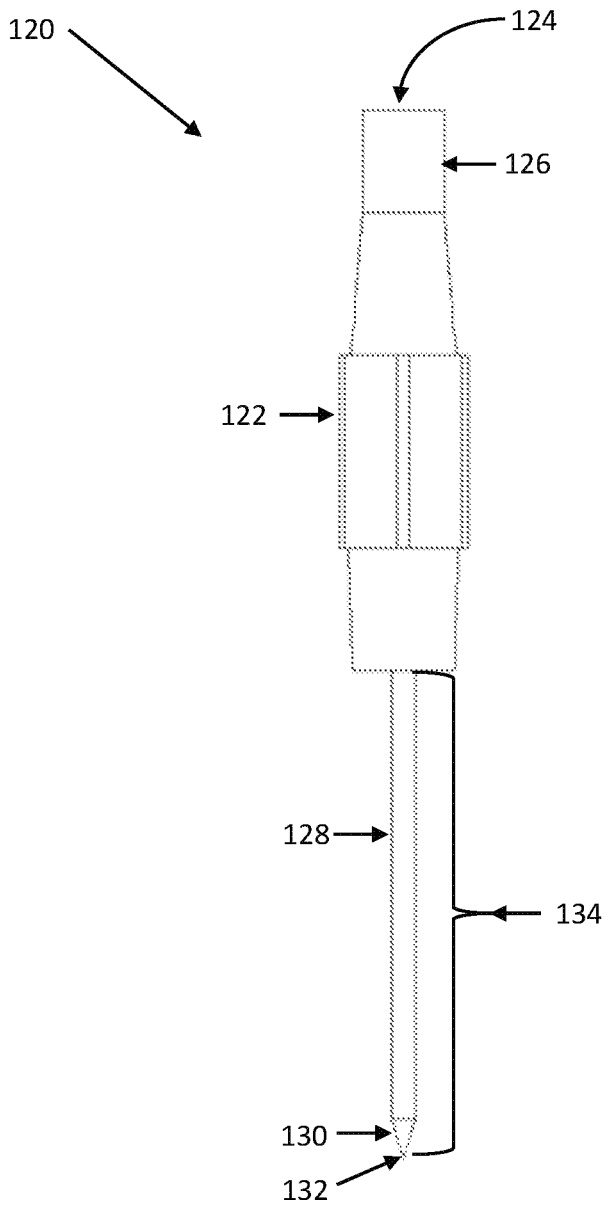
FIG. 2 is a schematic side view of a capillary glass tube.
Figure 6:
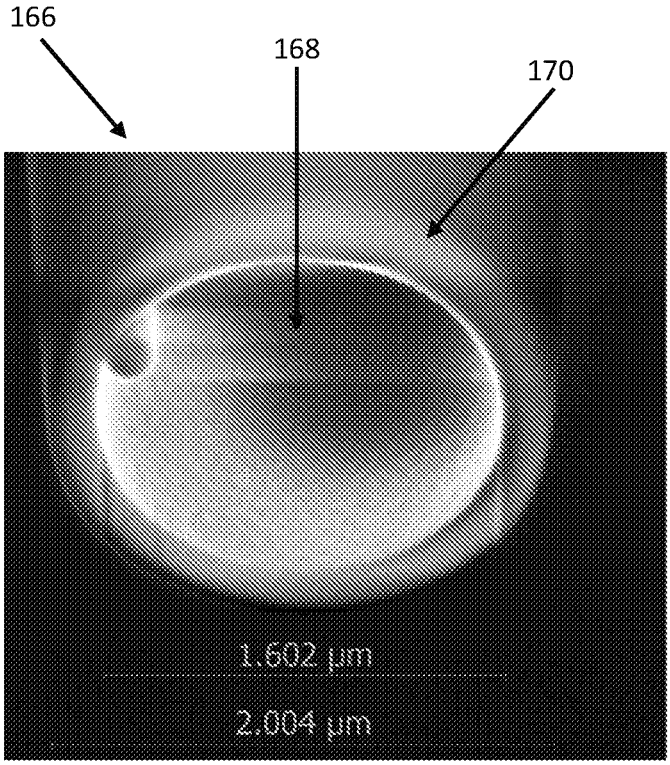
FIG. 6 is a scanning electron microscope (SEM) view of the output portion after focused-ion beam treatment, under high magnification.
Figure 7:
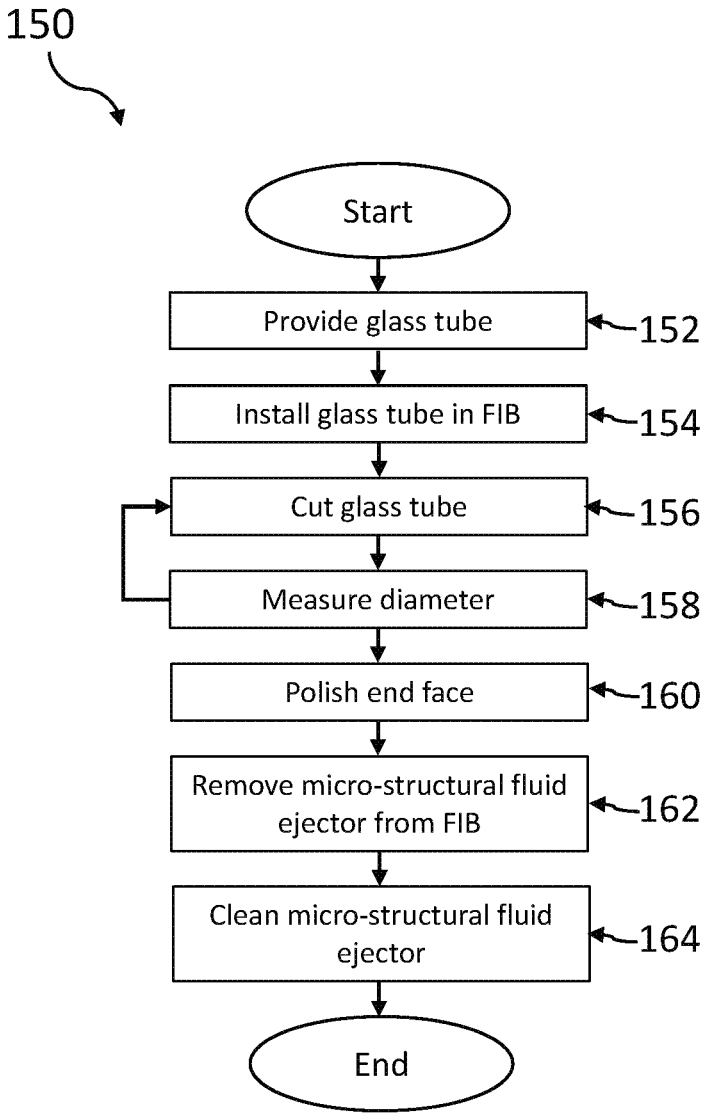
FIG. 7 is a flow diagram of a method of forming a micro-structural fluid ejector according to a second embodiment.

In a case where the output inner diameter (nominally 0.5 μm in this example) is too small, it is possible to increase the output inner diameter by cutting the capillary glass tube 120 at a suitable longitudinal location along the tapering portion 130, for example longitudinal location 140, 142, 144, 146, or 148. A method 150 of treating the capillary glass tube 120 to obtain a micro-structural fluid ejector 200 is shown in FIG. 7. At step 152, a capillary glass tube 120, such as shown in FIG. 2 is provided. At step 154, the capillary glass tube is installed in a focused-ion beam (FIB) apparatus. For example, a plasma-source $Xe^+$ FIB (also called PFIB) is used. At step 156, a longitudinal location along the tapering portion 130 is selected, and the focused ion beam is directed to it, with sufficient energy density for cutting the glass tube. At step 156, a cut is made using the focused-ion beam across the tapering portion at the selected longitudinal location. After the previous step 156 is completed, a scanning electron microscope (in the FIB apparatus) is used to measure the inner diameter at the output end (step 158). If the measured inner diameter is too small, step 156 is carried out at another longitudinal location along the tapering portion, and step 158 is carried out. Steps 156 and 158 are repeated until the desired inner diameter is obtained. As shown in FIG. 6, the final cutting (step 156) defines an output portion 166 including the exit orifice 168 and the end face 170. The exit orifice 168 has an output inner diameter ranging between 0.1 μm and 5 μm. In the example shown in FIG. 6, the output inner diameter is measured to be 1.602 μm and the output outer diameter is measured to be 2.004 μm. Then, at step 160, the energy of the focused ion beam is reduced, and the focused ion beam is directed to the end face 170. The end face 170 is polished using the focused ion beam, to obtain an end face with a surface roughness of less than 0.1 μm, and preferably ranging between 1 nm and 20 nm. In the end face example shown in FIG. 6, it can be deduced from the outer and inner diameter dimensions that the end face has a surface roughness of less than 0.1 μm. When the polishing capability of the FIB apparatus is taken into account, it is considered likely that the surface roughness of the end face ranges between 1 nm and 20 nm. Upon the conclusion of step 160, a micro-structural fluid ejector 200 is obtained. Then, at step 162, the micro-structural fluid ejector 200 is removed from the FIB apparatus. Additionally, it is preferable to clean the micro-structural fluid ejector, particularly the output portion, by immersion in a solvent while applying pressure in the range of 10,000 Pa to 1,000,000 Pa (step 164). We have found it effective to use a solvent that is identical to a solvent used in the fluid. For example, if the fluid contains methanol, it is found effective to use methanol as a solvent for cleaning in this step 164. The foregoing is a description of an example of a micro-structural fluid ejector obtained by modification of a capillary glass tube. More generally, it is contemplated that micro-structural fluid ejector can be obtained from other materials, such as plastics, metals, and silicon, or from a combination of materials.

Figure 8:
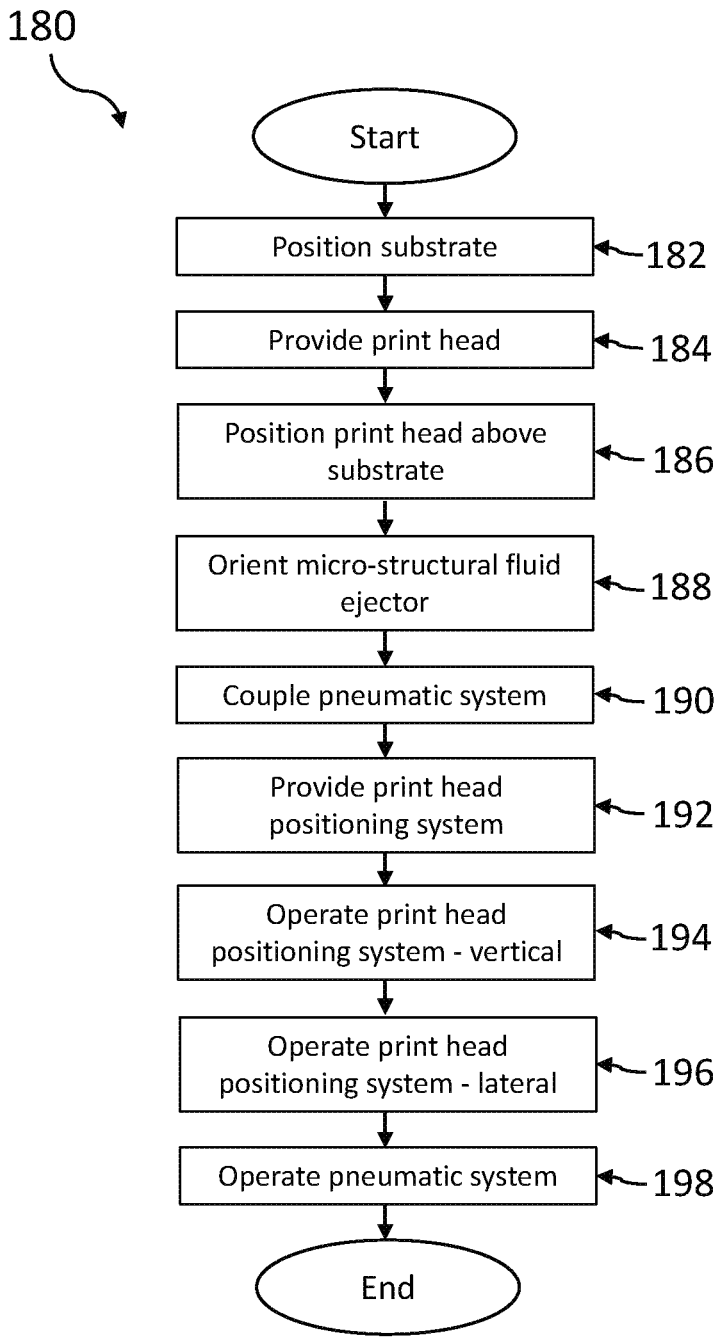
FIG. 8 is a flow diagram of a printing method.
Figure 11:
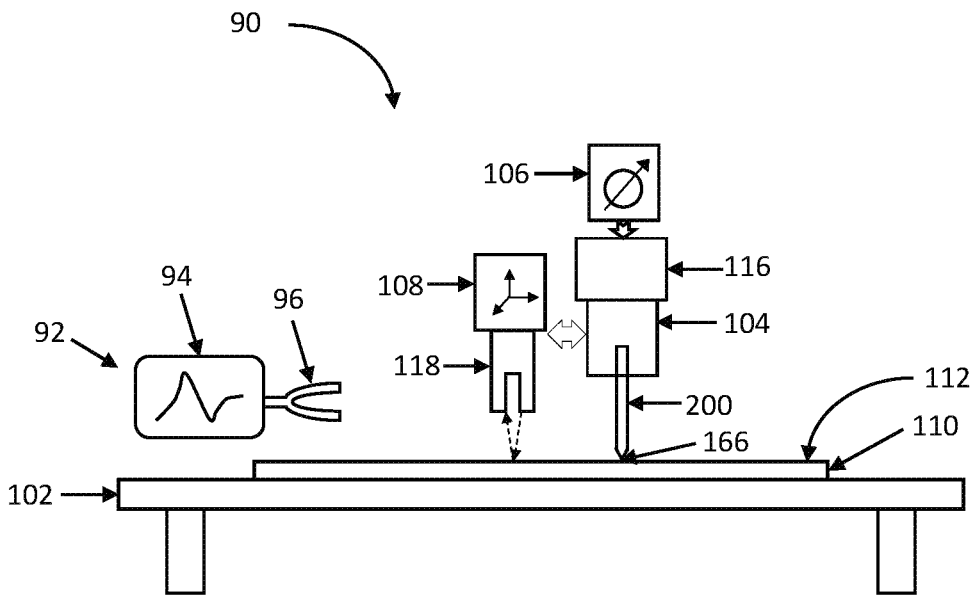
FIG. 11 is a block diagram view of an illustrative fluid printing apparatus according to a third embodiment.

Upon completion of step 162 and/or step 164, the micro-structural fluid ejector 200 is ready to install in the print head 104. FIG. 8 is a flow diagram of a printing method 180, in which a fluid printing apparatus is operated (FIG. 1, FIG. 11). At step 182, a substrate 110 is positioned at a fixed position on a substrate stage 102. At step 184, a print head 104 is provided. This step includes preparing the micro-structural fluid ejector, as described in FIG. 7, and installing it in a print head 104. At step 186, the print head 104 is positioned above the substrate 110 (FIG. 1). At step 188, the micro-structural fluid ejector 200 is oriented with the exit orifice 168 pointing downward and the end face 170 facing toward the printable surface 112 of the substrate 110. At step 190, a pneumatic system 106 is coupled to the print head 104. For example, the pneumatic system includes a pump and a pressure regulator.

Figure 9:
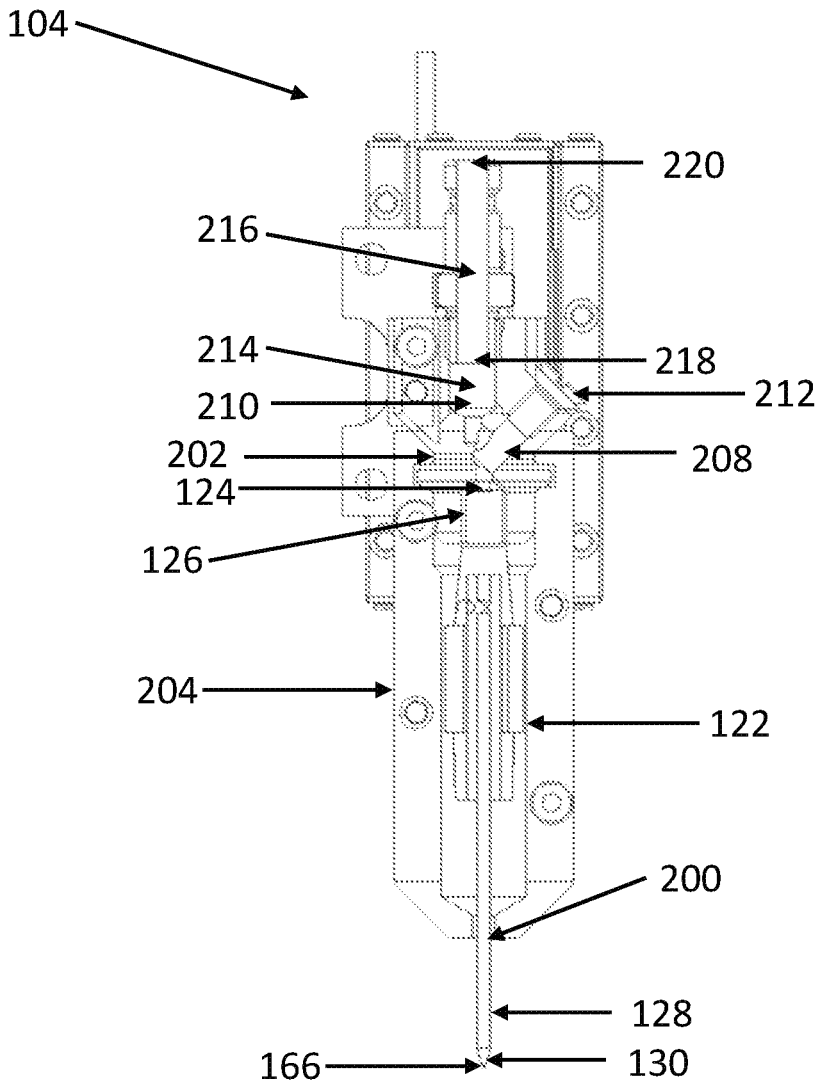
FIG. 9 is a cut-away schematic side view of a print head.

An example of a print head 104 is shown in FIG. 9. The print head 104 includes a micro-structural fluid ejector 200. A portion of the micro-structural fluid ejector 200, and its plastic handle 122, are encased in the external housing 204. The elongate input portion 128 extends downward from the external housing 204. An output portion 166, including the exit orifice 168 and end face 170 (FIG. 6), are located downward from the elongate input portion 128. The tapering portion 130 is located between the output portion 166 and the elongate input portion 128. The external housing 204 encases a main body 202, which includes a pneumatic conduit 210 and a fluid conduit 208. Both the pneumatic conduit 210 and the fluid conduit 208 are connected to the input end 124 of the plastic handle 122. The plastic handle 122 is attached to the main body 202 by the threaded portion 126 of the plastic handle 122. The pneumatic conduit 210 has a threaded portion 214 on its input end which is used to attach the output end 218 of a pneumatic connector 216 thereto. The pneumatic connector 216 has an input end 220 to which the pneumatic system 106 is connected (not shown in FIG. 9). Fluid (for example, ink) is supplied to the micro-structural fluid ejector 200 via the fluid conduit 208. As shown in FIG. 9, fluid conduit 208 is plugged with a fluid inlet plug 212, after fluid has been supplied to the micro-structural fluid ejector 200.

The printing method 180 is explained with continuing reference to FIG. 8. At step 192, a print head positioning system 108 is provided. The print head positioning system 108 controls the vertical displacement of the print head 104 and the lateral displacement of the print head 104 relative to the substrate. At step 194, the print head positioning system 108 is operated to control a vertical distance between the end face 170 and the printable surface 112 to within a range of 0 μm to 5 μm during the printing. At step 196, the print head positioning system 108 is operated to laterally displace the print head 104 relative to the substrate during the printing. The lateral displacement of the print head 104 relative to the substrate means one of the following options: (1) the substrate is stationary and the print head 104 is moved laterally;

(2) the print head 104 is not moved laterally and the substrate is moved laterally; and (3) both the print head 104 and the substrate are moved laterally. In option (1), the print head 104 is moved laterally and vertically. In option (2), the print head 104 is moved vertically but is not moved laterally, and the substrate stage, to which the substrate is fixed in position, is moved laterally. Additionally, in option (2), the print head positioning system 108 comprises a vertical positioner coupled to the print head 104 and a lateral positioner coupled to the substrate stage. At step 198, the pneumatic system 106 is operated, to apply pressure to the fluid in the micro-structural fluid ejector 200 via the elongate input portion 128. During the printing, the pressure is regulated to within a range of −50,000 Pa to 1,000,000 Pa.

Figure 10:
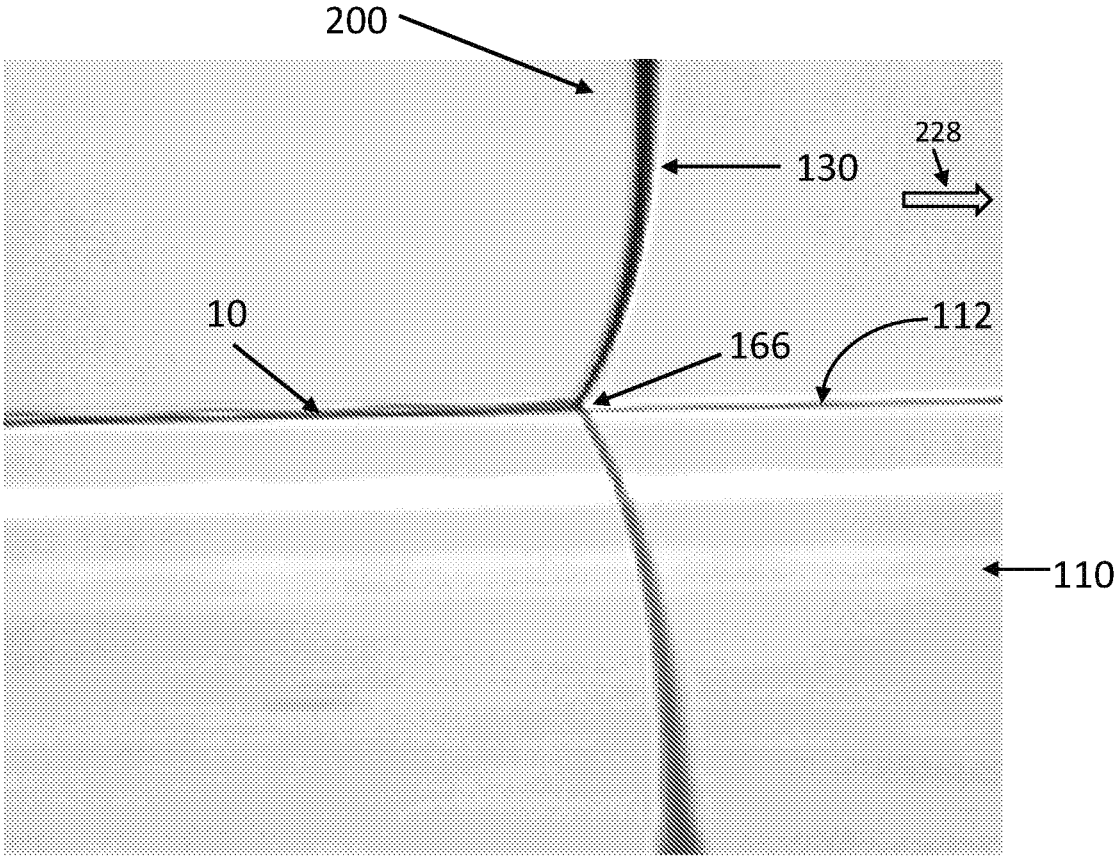
FIG. 10 is photograph of a side view of a micro-structural fluid ejector in contact with the substrate during printing.

The print head positioning system 108 controls the vertical distance between the end face 170 and the printable surface 112 to within 0 μm and 5 μm during the printing. The photograph of FIG. 10 shows an implementation in which the output portion 166 is in contact with the printable surface 112 of the substrate 110. The tapering portion 130, which is flexible because of its small diameter, is tilted or bent along the direct of lateral displacement of the micro-structural fluid ejector 200 (and of the print head 104). The direction of lateral displacement of the micro-structural fluid ejector 200 is shown by arrow 228 (towards the right in FIG. 10). If the output portion 166 ceased to be in contact with the printable surface, because of an unevenness of the printable surface for example, the tilt or bend of the tapering portion 130 would decrease. In this implementation, the apparatus includes an imaging system 114 (FIG. 1) which detects the tilt or bend of the tapering portion 130 as a result of the contact of the output portion 166 with the printable surface 112. The print head positioning system 108 adjusts the vertical displacement in response to the tilt or bend of the tapering portion 130 detected by the imaging system 114, thereby maintaining the output portion 166 in contact with the printable surface 112 during the printing. The print head positioning system 108 displaces the print head 104 and imaging system 114 together.

In the fluid printing apparatus 100, the print head 104 can eject a continuous stream of fluid through the exit orifice. Since the stream of fluid is continuous, a line of fluid can be formed on the printable surface 112. The line of fluid can be dried and/or sintered thereafter. It has been found that the print head positioning system 108 can laterally displace the print head 104 relative to the substrate at speeds within a range of 0.01 mm/sec to 1000 mm/sec during the printing. The line width of the line formed on the printable surface 112 depends in part on the size of the exit orifice 168, namely the output inner diameter. It has been found that when the print head positioning system 108 laterally displaces the print head 104 relative to the substrate at speeds within a range of 0.01 mm/sec to 1000 mm/sec during, the line width is greater than the output inner diameter by a factor ranging between 1.0 and 20.0.

During the printing, the pressure is regulated to within a range of −50,000 Pa to 1,000,000 Pa and the vertical distance between the end face 170 and the printable surface 112 is maintained within a range of 0 μm to 5 μm. The appropriate pressure range depends in part on the viscosity of the fluid. It is possible to print fluids in the range of 1 to 2000 centipoise. For lower viscosity fluids, in a range of 1 to 10 centipoise, the pressure is regulated to within a range of −50,000 Pa to 0 Pa during the printing. For these lower viscosity fluids, a negative pressure is needed to prevent excessive fluid flow out of the exit orifice 168. For fluids having a viscosity within a range of 100 to 200 centipoise, the pressure is regulated to within a range of 20,000 Pa to 80,000 Pa during the printing. It is hypothesized that a meniscus protrudes from the exit orifice 168 and contacts the printable surface 112, and there is wetting tension by virtue of contact between the fluid and the printable surface 112. In order to stop the flow of fluid onto the printable surface 112, the print head positioning system 108 increases the vertical distance between the end face 170 and the printable surface 112 to 10 μm or more. It has been found that reduction of the pressure at the end of printing on the printable surface can lead to clogging of the fluid in the micro-structural fluid ejector. Therefore, by increasing the vertical distance to 10 μm or more, the fluid continues to be ejected through the exit orifice 168 and accumulates on the outer wall of the micro-structural fluid ejector, instead of being printed on the printable surface 112. Fluids that can be printed include nanoparticle inks, such as inks containing titanium dioxide nanoparticles and silver nanoparticles. The nanoparticles can be quantum dot nanoparticles, such as CdSe, CdTe, and ZnO. Inks containing carbon black can also be printed.

FIG. 11 is a block diagram view of an illustrative fluid printing apparatus according to the third embodiment. The fluid printing apparatus 90 includes a substrate stage 102, a print head 104, a pneumatic system 106, and a print head positioning system 108, as discussed for the first embodiment. A substrate 110 is fixed in position on the substrate stage 102 during the printing and has a printable surface 112, which is facing upward and facing towards the print head 104. The print head 104 is positioned above the substrate 110. The print head 104 includes a micro-structural fluid ejector 200, which includes an output portion 166, as described in greater detail with respect to FIGS. 1 and 2. Although only one micro-structural fluid ejector is shown, a print head 104 could include multiple micro-structural fluid ejectors that print fluid concurrently, for higher productivity than with a single micro-structural fluid ejector. The output portion 166 includes an exit orifice 168 and an end face 170 (FIG. 6). The print head positioning system 108 maintains a vertical distance between the end face 170 of the output portion 166 and the printable surface 112 within a desired range, such as within a range of 0 μm to 5 μm during the printing. The fluid printing apparatus 90 includes a fluid reservoir 116 that is coupled to the print head 104. The pneumatic system 106 is coupled to the print head 104 via the fluid reservoir 116. Therefore, the pneumatic system 106 regulates the pressure of the fluid in the fluid reservoir 116 and in the micro-structural fluid ejector 200.

Figure 12:
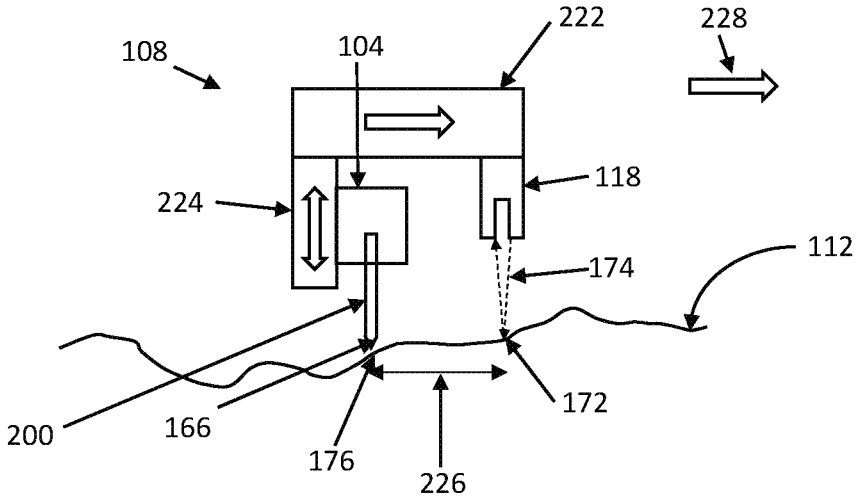
FIG. 12 is a block diagram view of a print head, a vertical displacement sensor, and a print head positioning system.

The fluid printing apparatus 90 includes a vertical displacement sensor 118, which can be implemented as a laser displacement sensor. Example laser displacement sensors are the HL-C2 series laser displacement sensors from Panasonic Industrial Devices. Details of an implementation are shown in FIG. 12. The print head positioning system 108 includes a print head lateral positioner 222 and a print head vertical positioner 224. The print head 104 is mounted to the print head vertical positioner 224, which is mounted to the print head lateral positioner 222. The direction of lateral displacement of the print head 104 is shown by arrow 228 (towards the right in FIG. 12). The vertical displacement sensor 118 is mounted to the print head lateral positioner 222 and measures a distance 174 between the sensor and a region 172 on the printable surface 112. Region 172 is referred to as a reference location and the distance 174 is referred to as a reference vertical displacement. At the same time, the output portion 166 of the micro-structural fluid ejector 200 is positioned above a region 176 on the printable surface 112. The vertical displacement sensor 118 is ahead of the output portion 166 by a lateral distance Δx which is the lateral distance 226 between regions 172 and 176. The reference vertical displacement 174 is stored in a memory store, such as a buffer memory. At the time that the output portion 166 arrives at region 172, the vertical positioner 224 adjusts the vertical displacement in response to the reference vertical displacement 174 (having been retrieved from the memory store) in order to maintain the vertical distance between the end face 170 of the output portion 166 and the region 172 of the printable surface 112 within a desired range, such as within a range of 0 μm to 5 μm. By use of this look-ahead feature, the print head positioning system 108 is able to maintain the distance between the end face 170 and the printable surface 112 within a desired range when the contour of the printable surface 112 is uneven, as shown in FIG. 12. An unevenness of the printable surface can be the unevenness of the bare substrate or can be attributed to the previously deposited material on the substrate, such as conductive lines or insulating layers.

Figure 23:
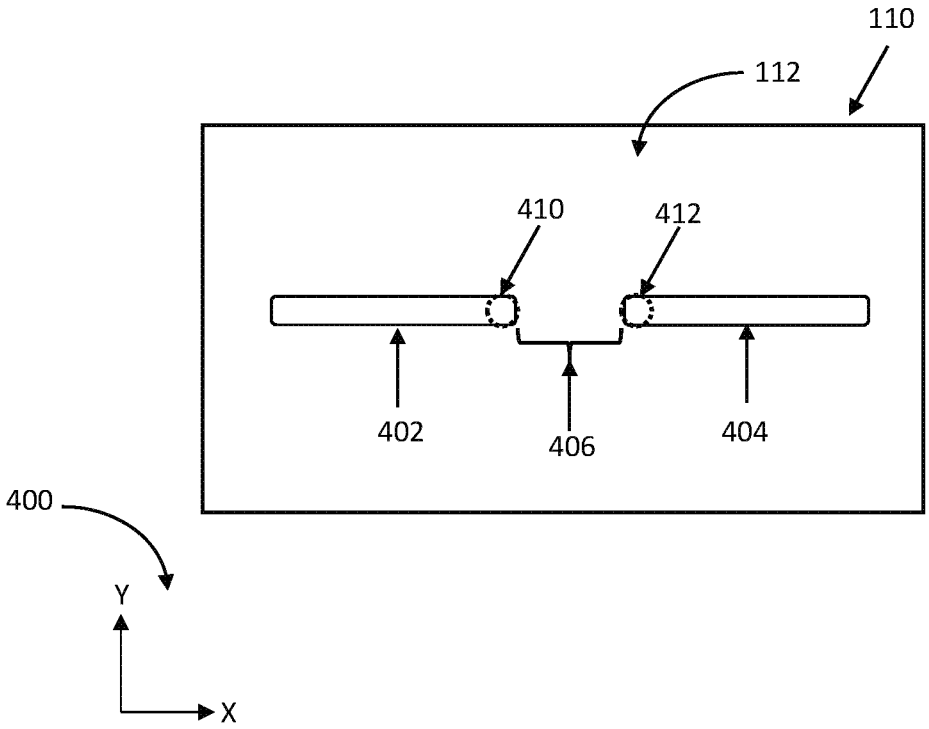
FIG. 23 is a schematic top view of a substrate that has an open defect.

A position calibration system according to the present disclosure is explained with reference to FIGS. 11, 13, 14, 15, 16, and 23. FIG. 23 is a schematic top view of a substrate 110 with the printable surface 112 facing toward the reader. A lateral coordinate system (X and Y coordinates) 400 for the substrate stage has been defined. In previous process steps, metal lines 402 and 404 have been formed. Actually, a continuous metal line including metal lines 402 and 404 was desired, but there is an open defect 406 between a right end region 410 of metal line 402 and a left end region 412 of metal line 404. In this case, the fluid printing apparatus 90 can be configured as an open defect repair apparatus, to correct this defect. The fluid printing apparatus 90 can be used to print a line of fluid, an ink containing either a metal or metal precursor, between the regions 410 and 412. Then the line of fluid is dried and/or sintered to form a metal line between regions 410 and 412. In order to start printing at region 410, it is necessary to know the coordinates of region 410.

Figure 13:
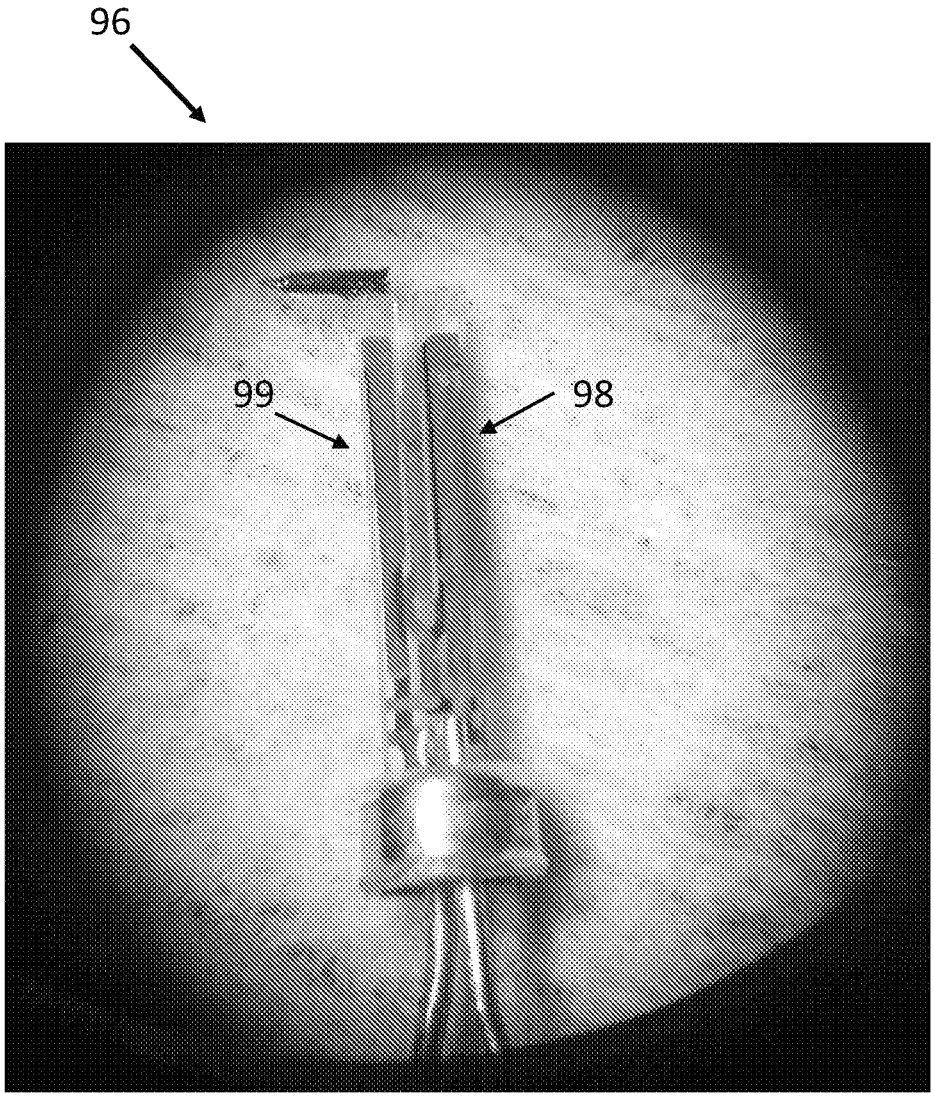
FIG. 13 is a photograph of a tuning fork.

A fluid printing apparatus 90 can include a position calibration system 92, which is used to calibrate the position of the output portion 166 (FIG. 11). Hence, the position calibration system 92 is sometimes referred to as an output portion position calibration system. The position calibration system 92 includes a tuning fork 96 and a measurement circuit 94 coupled to the tuning fork 96 (FIG. 11). FIG. 13 is a photograph of an illustrative tuning fork 96, which includes a first tine 98 and a second tine 99. It has an unperturbed resonance frequency $f_0$ of approximately 32.79 kHz, and a perturbed resonance frequencies $f_N$ of approximately 8.17 kHz when the output portion 166 is in contact with the first tine 98. The measurement circuit 94 generates a variable-frequency signal in a range of frequencies including the unperturbed resonance frequency $f_0$ and the perturbed resonance frequencies $f_N$ and transmits the signal to the tuning fork 96. This signal causes the tuning fork 96 to oscillate. The measurement circuit 94 measures a frequency response of the tuning fork 96 to the signal. If an output portion 166 is in contact with the first tine 98, a perturbed resonance frequency $f_N$ is detected.

Figure 14:
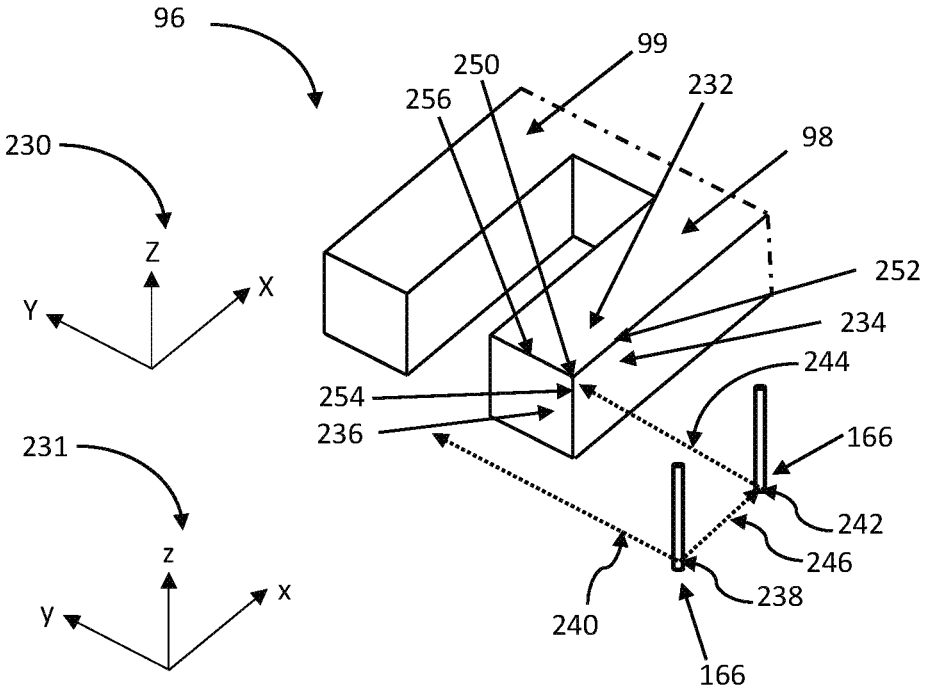
FIG. 14 is a schematic perspective view of a tuning fork to illustrate operation of a position calibration system, according to a fourth embodiment.

Details of a tuning fork implementation of a position calibration system, according to a fourth embodiment are shown in FIG. 14. FIG. 14 is a simplified perspective view of a tuning fork 96 including a first tine 98 and a second tine 99. A three-dimensional coordinate system 230 (X, Y, and Z coordinates) is defined. Coordinate system 230 is referred to as a first coordinate system. The first tine 98 includes a top face 232 (in X-Y plane), a side face 234 (in X-Z plane) and a front face 236 (in Y-Z plane). If the output portion 166 comes into contact with the top face 232, the side face 234, or the front face 236, a perturbed resonance frequency $f_N$ is detected. Top face 232 and side face 234 meet at a boundary line 252, side face 234 and front face 236 meet at a boundary line 254, and top face 232 and front face 236 meet at a boundary line 256. Top face 232, side face 234, and front face 236 meet at an apex 250. In this case, the apex 250 is referred to as a marker point, and top face 232, side face 234, and front face 236 are collectively referred to as a marker region. As can be seen in FIG. 14, the marker point is included in the marker region. Coordinates of the marker region and marker point are already precisely known in the first coordinate system (coordinate system 230). For example, the first coordinate system could be the coordinate system of the substrate stage 400 (FIG. 23).

On the other hand, the coordinates of the marker region and marker point are approximately known in a second coordinate system 231 (x, y, and z coordinates). The coordinates of the output portion 166 are precisely known in the second coordinate system 231. For example, the second coordinate system could be the coordinate system of the print head positioning system 108. First, the print head positioning system 108 positions the print head 104 so that the output portion 166 is at start position 238, in the vicinity of the tuning fork 96. While the measurement circuit 94 transmits the variable-frequency signal to the tuning fork 96 and measures the frequency response of the tuning fork 96, the print head positioning system 108 displaces the output portion 166 along a trajectory 240 towards the tuning fork 96. As the output portion 166 traverses the trajectory 240, the output portion 166 does not contact the marker region, so only the unperturbed resonance frequency $f_0$ is detected. The coordinates in the second coordinate system at which the unperturbed resonance frequency $f_0$ is detected are determined. Second, the output portion returns to start position 238 and traverses a trajectory 246 to a new start position 242. While the measurement circuit 94 transmits the variable-frequency signal to the tuning fork 96 and measures the frequency response of the tuning fork 96, the output portion 166 traverses a trajectory 244 from start position 242 towards the tuning fork 96. When the output portion 166 contacts the marker region at the side face 234, a perturbed resonance frequency $f_N$ is detected. The coordinates in the second coordinate system at which the perturbed resonance frequency $f_N$ is detected are determined. For example, from knowing the coordinates at which the output portion 166 missed contacting the side face 234 and the coordinates at which the output portion 166 came into contact with the side face 234, the coordinates of the boundary line 254 could be determined.

Similarly, the output portion 166 can be displaced to multiple coordinates to come into contact with top face 232 (or front face 236) and to miss coming into contact with top face 232 (or front face 236), while the measurement circuit 94 measures the frequency response of the tuning fork 96, to determine the coordinates of the boundary line 252 or boundary line 256. This is repeated until the coordinates of the marker point can be deduced from a map of the marker region including the marker point. When the coordinates of the marker point are known in the second coordinate system 231, the print head positioning system 108 can be calibrated. After the print head positioning system 108 has been calibrated, it becomes possible to precisely position the print head 104 at a known position in the first coordinate system 230. For example, in the case of the open defect repair apparatus example, it becomes possible to precisely position the print head's output portion 166 at region 410 (FIG. 23).

Figure 15:
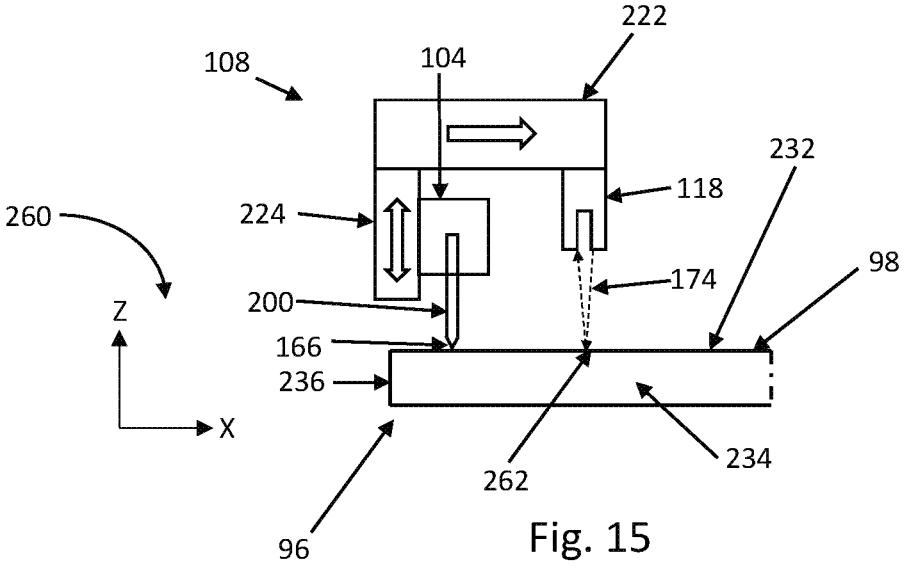
FIG. 15 is a schematic side view of a tuning fork to illustrate the operation of a position calibration system, according to a fifth embodiment.

A second tuning fork implementation of a position calibration system according to a fifth embodiment is shown in FIG. 15. A print head positioning system 108, previously explained with reference to FIG. 12 is shown. The print head positioning system 108 is positioned above the top face 232 of the first tine 98 of the tuning fork 96. A coordinate system 260 is the coordinate system of the print head positioning system 108 and is referred to as the first coordinate system. Both the vertical displacement sensor 118 and the vertical positioner 224 are mounted to the lateral positioner 222. However, the coordinates of the output portion 166 are not necessarily precisely known in the first coordinate system, because the length of each micro-structural fluid ejector 200 is different, each micro-structural fluid ejector 200 might be installed at a slightly different location in the print head 104, and a micro-structural fluid ejector 200 may wear down during use. Therefore, it may be necessary to calibrate the print head positioning system 108 based on precise coordinates of the output portion 166. The vertical displacement sensor 118 measures the distance 174 from the sensor to a marker region 262 on the top face 232. From this measurement, the coordinates (Z-coordinates) of marker region 262 are precisely known in the first coordinate system 260. The lateral positioner 222 displaces the print head 104 laterally to bring the output portion 166 directly above marker region 262. While the measurement circuit 94 (FIG. 11) transmits the variable-frequency signal to the tuning fork 96 and measures the frequency response of the tuning fork 96, the vertical positioner 224 displaces the print head 104 vertically towards marker region 262. When the output portion 166 contacts the marker region 262, a perturbed resonance frequency $f_N$ is detected. From this measurement the coordinates of the output portion 166 in the first coordinate system 260 can be determined, and the print head positioning system 108 can be calibrated.

Figure 16:
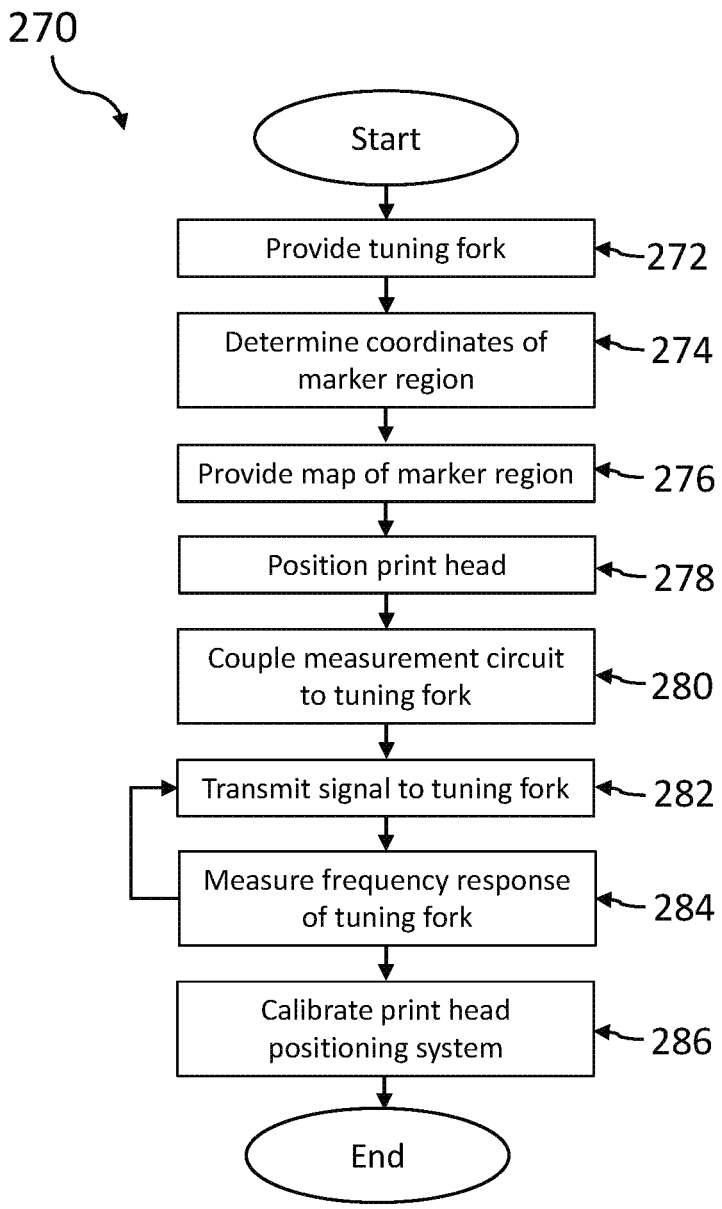
FIG. 16 is a flow diagram of a calibration method.

A method 270 of calibrating the print head positioning system 108 is shown in FIG. 16. At step 272, a tuning fork 96 is provided. The tuning fork 96 includes a first tine 98 with a marker region being located on the first tine 98. The tuning fork 96 is characterized by an unperturbed resonance frequency $f_0$ and perturbed resonance frequencies $f_N$ measurably different from the unperturbed resonance frequency $f_0$ when the output portion 166 is in contact with the marker region. At step 274, the coordinates of the marker region are determined in the first coordinate system. In the case of FIG. 15, the first coordinate system is the coordinate system of the print head positioning system 108, and the coordinates of the marker region are determined using a vertical displacement sensor 118. In the case of FIG. 14, the first coordinate system is the coordinate system of the substrate stage 102, and the marker region includes top face 232, side face 234, and front face 236. The coordinates of these faces 232, 234, and 236 in the first coordinate system have been determined. Additionally, in the case of FIG. 14, a map of the marker region including the marker point is provided (step 276). At step 278, the print head 104 is positioned to bring the output portion 166 in the vicinity of the tuning fork 96. In the case of FIG. 15, this step corresponds to displacing the print head 104 to bring the output portion 166 to directly above marker region 262. In the case of FIG. 14, this step corresponds to displacing the print head 104 to bring the output portion 166 to start position 238. At step 280, a measurement circuit 94 is coupled to the tuning fork 96. At step 282, the measurement circuit 94 transmits a variable-frequency signal in a range of frequencies including the unperturbed resonance frequency $f_0$ and the perturbed resonance frequencies $f_N$ to the tuning fork 96 to cause the tuning fork 96 to oscillate. At step 284, the measurement circuit 94 measures a frequency response of the tuning fork 96 to the signal while the output portion 166 is displaced to multiple coordinates, to determine the coordinates of the output portion 166 at which the perturbed resonance frequencies are detected. At step 286, the print head positioning system 108 is calibrated in response to the coordinates of the output portion 166 at which the perturbed resonance frequencies are detected. In the case of FIG. 14, the steps of transmitting the signal (step 282) and measuring the frequency response (step 284) are repeated until the coordinates of the marker point are determined from the map of the marker region including the marker point.

Figure 17:
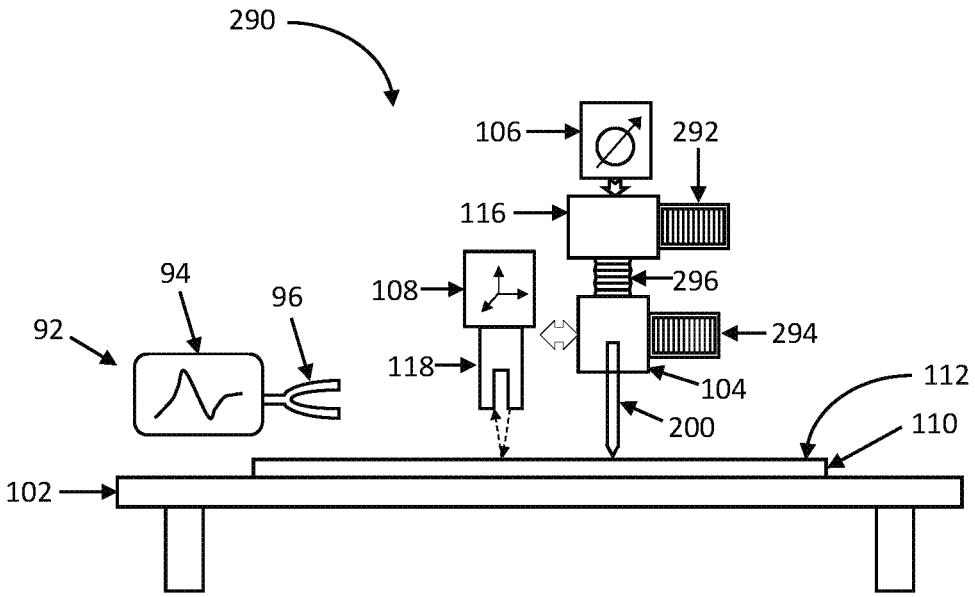
FIG. 17 is a block diagram view of an illustrative fluid printing apparatus according to a sixth embodiment.

FIG. 17 is a block diagram view of an illustrative fluid printing apparatus according to the sixth embodiment. The fluid printing apparatus 290 includes a substrate stage 102, a pneumatic system 106, a print head 104, a print head positioning system 108, a fluid reservoir 116, a vertical displacement sensor 118, and a position calibration system 92, as described above with reference to FIG. 11. Additionally, in the fluid printing apparatus 290, a piezoelectric actuator attached to a component causes the component to vibrate, resulting in a reduction of clogging of fluid in the component. Additionally, the piezoelectric actuator can be modulated. For example, a piezoelectric actuator 292 can be attached to the fluid reservoir 116, and the piezoelectric actuator 292 can be operated to cause the fluid reservoir 116 to vibrate. For example, a piezoelectric actuator 294 can be attached to the print head 104, and the piezoelectric actuator 294 can be operated to cause the micro-structural fluid ejector 200 to vibrate. An elastic fluid conduit 296 can be inserted between the fluid reservoir 116 and the elongate input portion 128 of the micro-structural fluid ejector 200, so that fluid flows from the fluid reservoir 116 to the elongate input portion 128 via the elastic fluid conduit 296. Such an elastic fluid conduit 296 may reduce the transmission of vibration from the print head 104 to the fluid reservoir 116 when the piezoelectric actuator 294 is operated or from the fluid reservoir 116 to the print head 104 when the piezoelectric actuator 292 is operated.

As discussed with reference to FIG. 10, the tapering portion 130 of the micro-structural fluid ejector 200 is tilted or bent along the direction of lateral displacement of the print head 104 relative to the substrate when the output portion 166 is in contact with the printable surface 112. It has been found that operation in this contact mode causes uneven wear of the output portion 166. One way to make the wear more even is to traverse the print head 104 along a path in a first direction (for example towards the right in FIG. 10) and then traverse the print head 104 along the same path in a second direction opposite the first direction (for example towards the left in FIG. 10). For example, the print head 104 can reverse direction after reaching an end region of a substrate 102.

Figure 18:
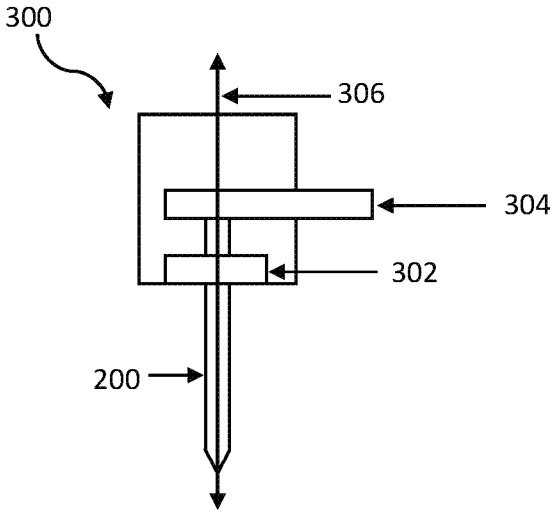
FIG. 18 is a block diagram view of an illustrative print head according to a seventh embodiment.

Another solution is illustrated with reference to FIG. 18. FIG. 18 shows an illustrative print head 300 according to a seventh embodiment. Print head 300 is an improved print head that makes the wear on the output portion more even. Print head 300 could replace print head 104 in the illustrative printing apparatuses disclosed herein. This print head 300 includes a micro-structural fluid ejector 200, as discussed for print head 104. The micro-structural fluid ejector 200 is mounted in a mounting receptacle 302. When mounted in the mounting receptacle 302, the micro-structural fluid ejector 200 is rotatable about its longitudinal axis 306. A rotation device 304 is coupled to the micro-structural fluid ejector 200. During operation, the rotation device 304 imparts a controlled rotation to the micro-structural fluid ejector 200 about its longitudinal axis 306. For example, the rotation device 304 is operated while the apparatus is printing fluid. As a result, the output portion 166 of the micro-structural fluid ejector 200 wears evenly about its longitudinal axis 306.

Figure 19:
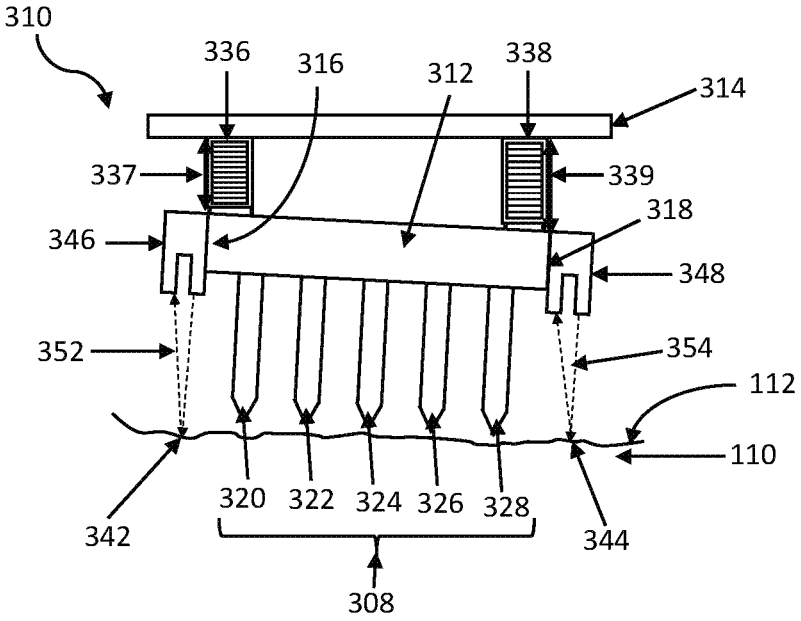
FIG. 19 is a schematic side view of an illustrative print head module.

An illustrative fluid printing apparatus according to an eighth embodiment is explained with reference to FIGS. 19, 20, 21, and 22. An illustrative print head module 310 is shown in FIG. 19. The print head module 310 includes a bank 308 of micro-structural fluid ejectors 320, 322, 324, 326, 328. During printing, the micro-structural fluid ejectors print concurrently to achieve higher productivity than with a single micro-structural fluid ejector. Preferred micro-structural fluid ejectors and their preparation have been described with reference to FIGS. 2 through 7. The bank of micro-structural fluid ejectors 308 is arrayed along a common rail 312 between its first end 316 and its second end 318, which is opposite the first end 316. A first vertical displacement sensor 346 is positioned near the first end 316 and a second vertical displacement sensor 348 is positioned near the second end 318. In FIG. 19 the print head module 310 is positioned above the substrate 110, with the micro-structural fluid ejectors oriented with the output portions pointing downward and the end faces facing toward the printable surface 112. When implemented in a fluid printing apparatus, the bank of micro-structural fluid ejectors 308 is suspended from the common rail 312. The first vertical displacement sensor 346 is oriented to measure a first reference vertical displacement 352 to a first reference location 342 on printable surface 112, and the second vertical displacement sensor 348 is oriented to measure a second reference vertical displacement 354 to a second reference location 344 on printable surface 112.

Figure 21:
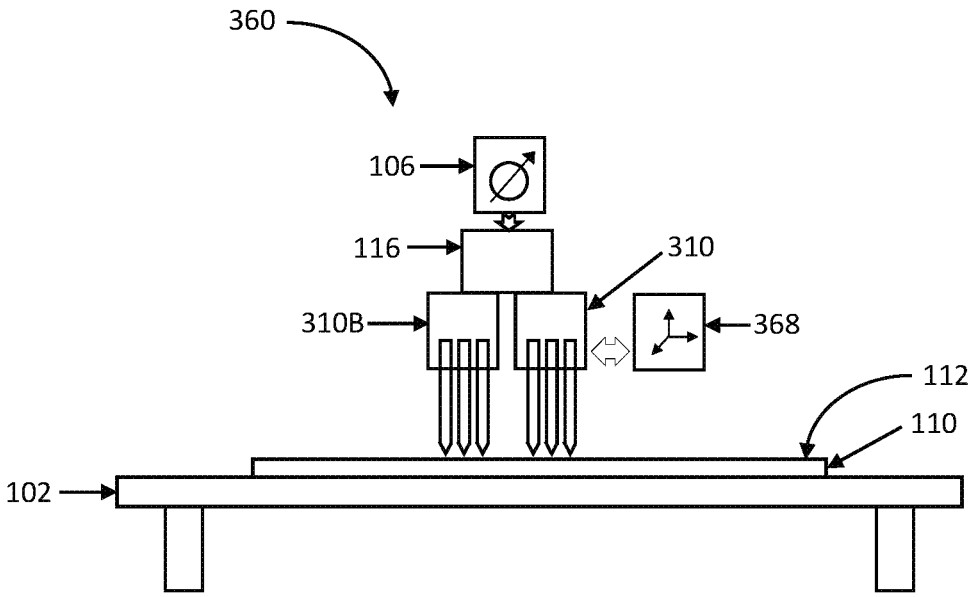
FIG. 21 is a block diagram view of an illustrative fluid printing apparatus according to an eighth embodiment.

The common rail 312 is attached to a base support 314 via a first piezoelectric stack linear actuator 336 which attaches the first end 316 to the base support 314 and a second piezoelectric stack linear actuator 338 which attaches the second end 318 to the base support 314. When implemented in a fluid printing apparatus, the common rail 312 is suspended from the base support 314 via the piezoelectric stack linear actuators 336, 338. The first piezoelectric stack linear actuator 336 is oriented and configured to adjust a first vertical separation 337 between the first end 316 and the base support 314, in response to the first reference vertical displacement 352 measured by the first vertical displacement sensor 346. The second piezoelectric stack linear actuator 338 is oriented and configured to adjust a second vertical separation 339 between the second end 318 and the base support 314, in response to the second reference vertical displacement 354 measured by the second vertical displacement sensor 348. An illustrative fluid printing apparatus according to the eighth embodiment is shown in FIG. 21. The fluid printing apparatus 360 includes a substrate stage 102, a pneumatic system 106, and a fluid reservoir 116, as described with reference to FIG. 11. The fluid printing apparatus 360 includes a print head module 310 and can include additional print head module(s) 310B, for higher productivity than with a single print head module 310. The base support 314 of the print head module 310 is mounted to the print head module positioning system 368, which controls the vertical displacement and the lateral displacement of the base support 314.

Figure 20:
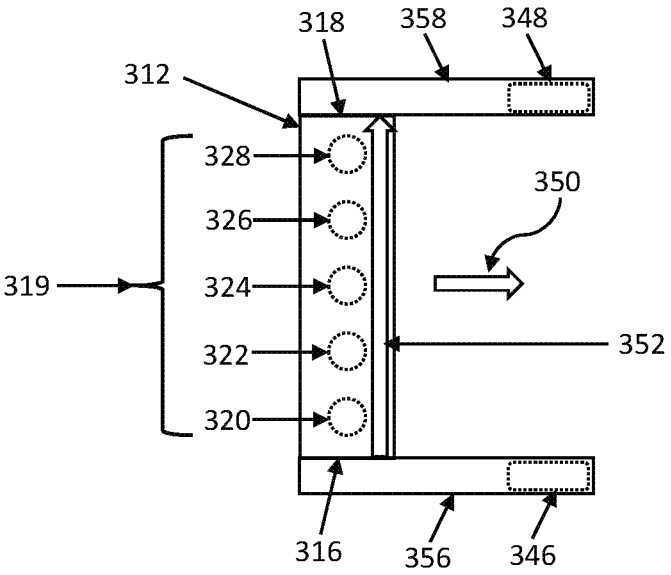
FIG. 20 is a schematic top view of the some of the components of FIG. 19.

In the situation illustrated in FIG. 19, the printable surface 112 of the substrate 110 is uneven. A look-ahead feature is explained with reference to FIG. 12. A similar look-ahead feature can be implemented in the fluid printing apparatus of FIG. 21. FIG. 20 is a top schematic view of some of the components of the print head module 310. During printing, the base support 314 of the print head module 310 is laterally displaced relative to the substrate along a direction of lateral displacement 350, approximately perpendicular to a vector 352 from the first end 316 to the second end 318. According to this arrangement, the micro-structural fluid ejectors 320, 322, 324, 326, 328 print fluid concurrently, resulting in greater productivity than with a single micro-structural fluid ejector. The first vertical displacement sensor 346 is mounted to a first common rail extension 356 which extends from or is attached to the first end 316. Similarly, the second vertical displacement sensor 348 is mounted to a second common rail extension 358 which extends from or is attached to the second end 318. According to this arrangement, the first vertical displacement sensor 346 and the second vertical displacement sensor 348 are positioned ahead of the bank of micro-structural fluid ejectors 308 along the direction of lateral displacement 350.

Figure 22:
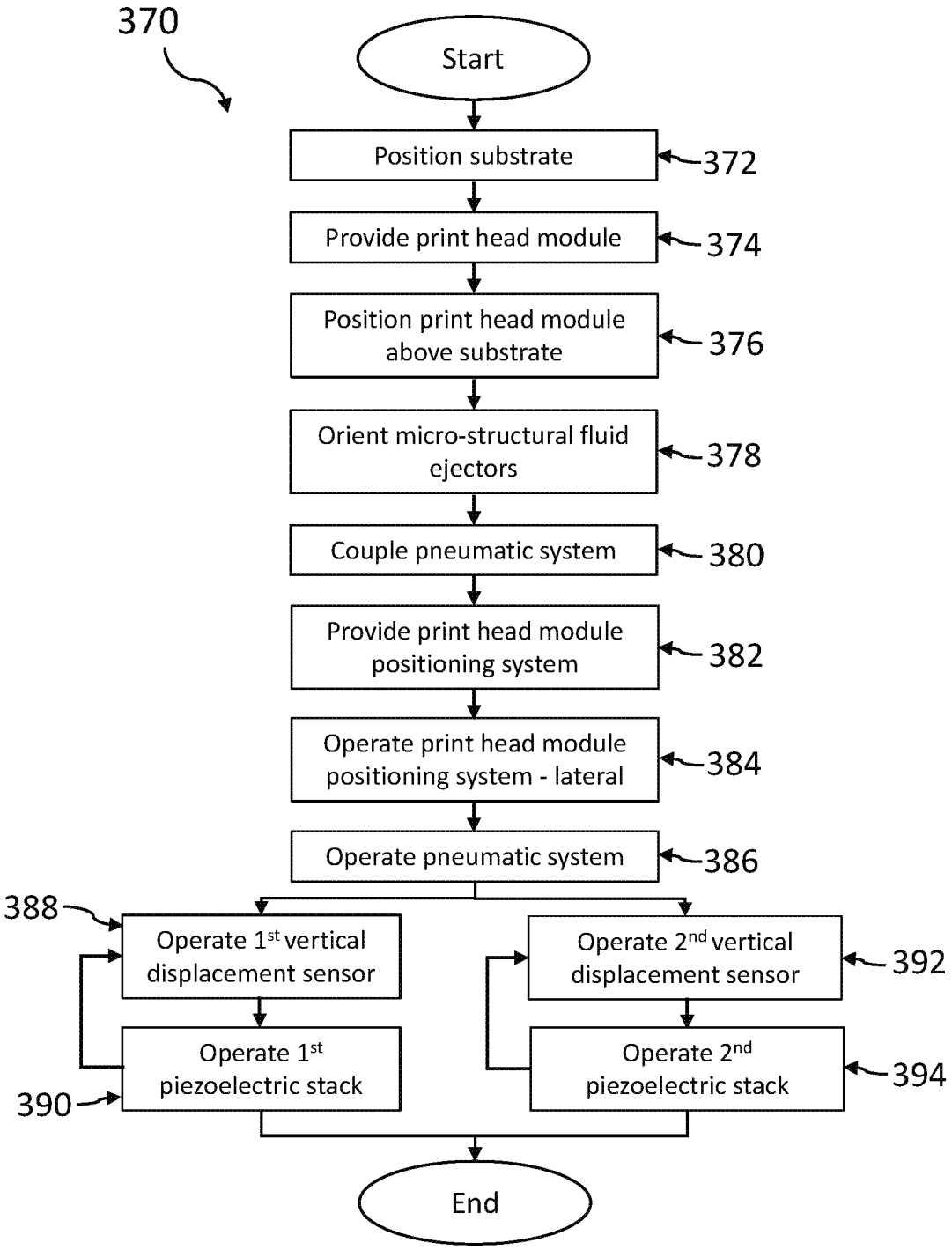
FIG. 22 is a flow diagram of a printing method, including operation of the illustrative fluid printing apparatus of the eighth embodiment.

FIG. 22 is a flow diagram of a printing method 370, in which the apparatus 360 of the eighth embodiment is operated (FIG. 21). At step 372, a substrate 110 is positioned at a fixed position on a substrate stage 102. At step 374, a print head module 310 is provided, as described with reference to FIG. 19. At step 376, the print head module 310 is positioned above the substrate 110 (FIGS. 19 and 21). At step 378, the micro-structural fluid ejectors are oriented with the respective exit orifices pointing downward and the respective end faces facing toward the printable surface 112 of the substrate 110. At step 380, a pneumatic system 106 is coupled to the print head module 310. At step 382, a print head module positioning system 368 is provided. The print head positioning system 368 controls the vertical displacement of the base support 314 of the print head module 310 and the lateral displacement of the base support 314 of the print head module 310 relative to the substrate. At step 384, the print head module positioning system 368 is operated to laterally displace the base support 314 of the print head module 310 relative to the substrate during the printing. At step 386, the pneumatic system is operated, to apply pressure to the fluid in the micro-structural fluid ejectors 320, 322, 324, 326, 328 via the respective elongate input portions. During the printing, the pressure is regulated to within a range of −50,000 Pa to 1,000,000 Pa. The steps relating to the first vertical displacement sensor and the first piezoelectric stack linear actuator (steps 388, 390) and the steps relating to the second vertical displacement sensor and the second piezoelectric stack linear actuator (steps 392, 394) can be executed concurrently. At step 388, the first vertical displacement sensor 346 is operated to measure a first reference vertical displacement 352 to a first reference location 342 on the printable surface 112. At step 390, the first piezoelectric stack linear actuator 336 is operated to adjust the first vertical separation 337 between the first end 316 and the base support 314 in response to the first reference vertical displacement 352. Similarly, at step 392, the second vertical displacement sensor 348 is operated to measure a second reference vertical displacement 354 to a second reference location 344 on the printable surface 112. At step 394, the second piezoelectric stack linear actuator 338 is operated to adjust the second vertical separation 339 between the second end 318 and the base support 314 in response to the second reference vertical displacement 354. These adjustments are made to maintain the vertical distance between the end face and the printable surface to within a desired range, such as within a range of 0 μm to 5 μm, for some or all of the micro-structural fluid ejectors 320, 322, 324, 326, 328. The steps 388, 390, 392, and 394 are repeated as the print head module 310 is laterally displaced relative to the substrate over the printable surface 112 during the printing.

Unless otherwise indicated, all numbers expressing quantities of components, molecular weights, and so forth used in the specification and claims are to be understood as being modified in all instances by the term "about." Accordingly, unless otherwise indicated to the contrary, the numerical parameters set forth in the specification and claims are approximations that may vary depending upon the desired properties sought to be obtained. At the very least, and not as an attempt to limit the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the claimed subject matter are approximations, the numerical values set forth in the specific examples are reported as precisely as possible. All numerical values, however, inherently contain a range necessarily resulting from the standard deviation found in their respective testing measurements.

All headings are for the convenience of the reader and should not be used to limit the meaning of the text that follows the heading, unless so specified.

What is claimed is:

1. A method of printing fluid on a printable surface of a substrate, comprising the steps of:

positioning the substrate at a fixed position on a substrate stage;

providing a print head comprising a micro-structural fluid ejector, the micro-structural fluid ejector comprising: (1) an output portion comprising an exit orifice of an output inner diameter ranging between 0.1 μm and 5 μm and an end face having a surface roughness of less than 0.1 μm, (2) an elongate input portion having a input inner diameter that is greater than the output inner diameter by a factor of at least 100, and (3) a tapering portion between the elongate input portion and the output portion;

positioning the print head above the substrate;

orienting the micro-structural fluid ejector with the exit orifice pointing downward and the end face facing toward the printable surface;

coupling a pneumatic system to the print head;

providing a print head positioning system which controls a vertical displacement of the print head and a lateral displacement of the print head relative to the substrate;

operating the print head positioning system to control a vertical distance between the end face and the printable surface to within a range of 0 μm and 5 μm during the printing;

operating the print head positioning system to laterally displace the print head during the printing; and operating the pneumatic system to apply pressure to the fluid in the micro-structural fluid ejector via the elongate input portion, the pressure being regulated to within a range of −50,000 Pa to 1,000,000 Pa during the printing;

wherein fluid is ejected through the exit orifice in a continuous stream during the printing without any applied electric field between the print head and the substrate, the continuous stream forming a line of fluid on the printable surface.

2. The method of claim 1, wherein the step of operating the print head positioning system to laterally displace the print head comprises laterally displacing the print head relative to the substrate at speeds within a range of 0.01 mm/sec to 1000 mm/sec during the printing.

3. The method of claim 2, wherein the line on the printable surface has a line width greater than the output inner diameter by a factor ranging between 1.0 to 20.0.

4. The method of claim 1, wherein the surface roughness ranges between 1 nm and 20 nm.

5. The method of claim 1, further comprising the step of:

operating the print head positioning system to increase the vertical distance to 10 μm or more to stop flow of fluid onto the printable surface.

6. The method of claim 1, wherein the micro-structural fluid ejector comprises glass.

7. The method of claim 1, wherein the pneumatic system comprises a pump and a pressure regulator.

8. The method of claim 1, wherein the step of operating the print head positioning system to control the vertical distance further comprises adjusting the vertical displacement to maintain the tapering portion in contact with the printable surface during the printing.

9. The method of claim 8, wherein:

the step of operating the print head positioning system to laterally displace the print head comprises laterally displacing the print head relative to the substrate along a direction of lateral displacement during the printing; and the tapering portion is tilted or bent along the direction of lateral displacement during the printing.

10. The method of claim 9, wherein:

the method further comprises the step of operating an imaging system to detect the tilt or bend of the tapering portion; and the step of operating the print head positioning system to control the vertical distance further comprises adjusting the vertical displacement in response to a detected slant.

11. The method of claim 1, wherein:

the method further comprises the step of operating a vertical displacement sensor to measure a reference vertical displacement to a reference location on the printable surface; and the step of operating the print head positioning system to control the vertical distance further comprises adjusting the vertical displacement in response to the measured reference vertical displacement.

12. The method of claim 11, wherein the vertical displacement sensor is a laser displacement sensor.

13. The method of claim 11, wherein:

the step of operating the print head positioning system to laterally displace the print head comprises laterally displacing the print head relative to the substrate along a direction of lateral displacement during the printing; and the vertical displacement sensor is positioned ahead of the micro-structural fluid ejector along the direction of lateral displacement during the printing.

14. The method of claim 1, further comprising the steps of:

providing a tuning fork, comprising a first tine, a marker region being located on the first tine, the tuning fork being characterized by an unperturbed resonance frequency $f_0$ and perturbed resonance frequencies $f_N$ measurably different from the unperturbed resonance frequency $f_0$ when the output portion is in contact with the marker region;

determine coordinates of the marker region in a first coordinate system;

positioning the print head to bring the output portion in a vicinity of the tuning fork;

coupling a measurement circuit to the tuning fork;

transmitting a variable-frequency signal in a range of frequencies including the unperturbed resonance frequency $f_0$ and the perturbed resonance frequencies $f_N$ to the tuning fork to cause the tuning fork to oscillate;

measuring a frequency response of the tuning fork to the signal while the output portion is displaced to multiple coordinates, to determine the coordinates of the output portion at which the perturbed resonance frequencies are detected; and calibrating the print head positioning system in response to the coordinates of the output portion at which the perturbed resonance frequencies are detected.

15. The method of claim 14, wherein:

the marker region includes a marker point; and the method further comprises the steps of:

providing a map of the marker region including the marker point in a memory store; and repeating the step of measuring the frequency response until the coordinates of the marker point have been determined from the map.

16. The method of claim 1, wherein the fluid has a viscosity within a range of 1 to 2000 centipoise.

17. The method of claim 16, wherein the fluid has a viscosity within a range of 1 to 10 centipoise, and the step of operating the pneumatic system comprises regulating the pressure to within a range of −50,000 Pa to 0 Pa during the printing.

18. The method of claim 16, wherein the fluid has a viscosity within a range of 100 to 200 centipoise, and the step of operating the pneumatic system comprises regulating the pressure to within a range of 20,000 Pa to 80,000 Pa during the printing.

19. The method of claim 1, wherein the fluid comprises nanoparticles.

20. The method of claim 19, wherein the nanoparticles comprise quantum dots.

21. The method of claim 1, wherein the fluid comprises an element selected from the group consisting of: silver, titanium, and carbon.

22. The method of claim 1, wherein the print head further comprises a second micro-structural fluid ejector.

23. The method of claim 1, further comprising the step of coupling a fluid reservoir to the print head.

24. The method of claim 23, further comprising the steps of:

coupling a piezoelectric actuator to the fluid reservoir; and operating the piezoelectric actuator to cause vibration of the fluid reservoir.

25. The method of claim 24, wherein the step of operating the piezoelectric actuator comprises modulating the vibration of the fluid reservoir.

26. The method of claim 23, further comprising the step of providing an elastic fluid conduit between the fluid reservoir and the elongate input portion.

27. The method of claim 1, further comprising the steps of:

coupling a piezoelectric actuator to the print head; and operating the piezoelectric actuator to cause vibration of the micro-structural fluid ejector.

28. The method of claim 27, wherein the step of operating the piezoelectric actuator comprises modulating the vibration of the micro-structural fluid ejector.

29. The method of claim 1, wherein the step of providing a print head comprises:

providing a glass tube;

installing the glass tube in a focused-ion beam apparatus;

directing the focused-ion beam towards a tapering portion of the glass tube to cut across the tapering portion to define an output portion including the exit orifice and the end face;

polishing the end face using the focused-ion beam, such that the surface roughness of the end face is less than 0.1 μm, to obtain a micro-structural fluid ejector; and removing the micro-structural fluid ejector from the focused-ion beam apparatus.

30. The method of claim 1, further comprising the step of:

cleaning the output portion, comprising submerging the output portion in a solvent while operating the pneumatic system to apply pressure within a range of 10,000 Pa to 1,000,000 Pa.

31. The method of claim 1, wherein the step of operating the print head positioning system to laterally displace the print head comprises traversing the print head along a path in a first direction and then traversing the print head along the path in a second direction opposite the first direction.

32. A method of repairing open defects, comprising the method claim 1.

33. The method of claim 1, further comprising the steps of:

mounting a micro-structural fluid ejector in a mounting receptacle, the micro-structural fluid ejector being rotatable about its longitudinal axis when mounted in the mounting receptacle;

coupling a rotation device to the micro-structural fluid ejector; and imparting a controlled rotation to the micro-structural fluid ejector about its longitudinal axis.

* * * * *